US005183498A

United States Patent [19]

Haun et al.

[11] Patent Number: 5,183,498

[45] Date of Patent: Feb. 2, 1993

[54] GAS BARRIER FOR THE REFINING SUPERALLOY

[75] Inventors: Robert E. Haun, Ukiah; Neil C. Elmer, Potter Valley; Robin A. Lampson, Ukiah, all of Calif.

[73] Assignee: Retech, Inc., Ukiah, Calif.

[21] Appl. No.: 796,102

[22] Filed: Nov. 21, 1991

[51] Int. Cl.[5] ..... C21B 3/04

[52] U.S. Cl. ..... 75/709; 75/582; 266/229

[58] Field of Search ..... 266/229; 75/582, 709

[56] References Cited

U.S. PATENT DOCUMENTS 5,004,495 4/1991 Labate ..... 75/582

*Primary Examiner*—Peter D. Rosenberg
*Attorney, Agent, or Firm*—Townsend and Townsend

[57] ABSTRACT

The disclosure is made for the use of a hearth for receiving metals to be melted and exposing the molten metals to the furnace atmosphere with the upper surface of the molten metal free to float impurities such as oxides, carbides, or other undesirable materials on the upper surface of the molten metal or alloy. Gas jets blow an inert gas in one direction over the upper surface of the molten metal, generally parallel to the upper surface of the molten alloy. Thus, the gas jets remove impurities from the upper surface of the molten alloy by blowing or skimming the impurities off the top of the pool toward the walls of the hearth. The preferred position of the gas jets is in the notch of the hearth over which the molten alloy flows from the main body of the hearth into a withdrawal crucible. Moreover, the blowing gas under pressure does not cause appreciable loss of the molten alloy, and the gas jets, when blowing inert gas across the upper surface of the molten alloy, do not adversely affect the performance of a plasma torch above the hearth and operating to melt the solid alloy to a molten condition in the hearth.

20 Claims, 1 Drawing Sheet

GAS BARRIER FOR THE REFINING SUPERALLOY

This invention relates to improvements in the removal of impurities from molten metals and, more particularly, to an improved apparatus and method for refining a molten metal of the type suitable for flow in a molten state into a crucible.

BACKGROUND OF THE INVENTION

State of the art metallurgy of Ni-based superalloys has established that oxides and carbides represent impurities which are detrimental to many of the mechanical properties of these alloys. Removal of such impurities is desirable and such removal is most readily achieved when the superalloys are in the molten state. Otherwise, the impurities are difficult to dislodge from the superalloys, and the superalloys continue to be contaminated by such impurities.

SUMMARY OF THE INVENTION

The present invention provides a solution to the problem of removal of impurities from molten alloys of different types, such as Ni-based alloys, stainless steel-based alloys, cobalt-based alloys and the like. To achieve this end, the present invention provides a hearth for receiving molten metals and exposing the metals to the atmosphere with the upper surface of the molten metal free to support oxides and carbides.

The apparatus of the present invention further includes gas jets which blow a gas in one direction over the upper surface of the molten metal, generally parallel to the upper surface of the molten alloy. Thus, the gas operating under pressure, removes impurities from the upper surface of the molten alloy by blowing or skimming the impurities off the top of the pool toward the walls of the hearth itself.

The impurities can be urged into specific regions of the hearth where such impurities can then be collected and removed from the hearth. In any case, the impurities are separated from the molten alloy as the alloy leaves the hearth and is directed while molten into a withdrawal crucible or tundish.

The gas from the gas jets may be an inert gas or a non-inert gas. If it is non-inert, the gas could still skim the molten metal surface while providing additional refining capabilities.

An ideal position of the gas jets is in the notch of the hearth over which the molten alloy flows from the main body of the hearth into the withdrawal crucible. Moreover, the blowing gas under pressure does not cause appreciable loss of the molten alloy, and the gas jets, when blowing the gas across the upper surface of the molten alloy, does not adversely affect the performance of a plasma torch above the hearth and operating to melt the solid alloy to a molten condition in the hearth.

The gas barrier technique of the present invention has certain advantages over the state of the art melting techniques. As one advantage, the impurities are all substantially removed from the molten alloy to thereby yield a higher quality ingot which is nearly defect-free. Moreover, plasma arc hearth melting is ideally suited to the use of a gas barrier because the inert chamber and torch gases can be recirculated, thereby reducing production costs.

The primary object of the present invention is to provide an improved apparatus and method which includes a hearth for plasma arc melting of an alloy and gas jet structure to blow a gas across the upper surface of a molten metal alloy to remove the floating impurities on the upper surface of the molten alloy and to remove the impurities from the hearth.

Other objects of the present invention will become apparent as the following specification progresses, reference being had to the accompanying drawings for an illustration of a preferred embodiment of the invention.

DETAILED DESCRIPTION OF THE PREFERRED EMBODIMENT

Figure 1:
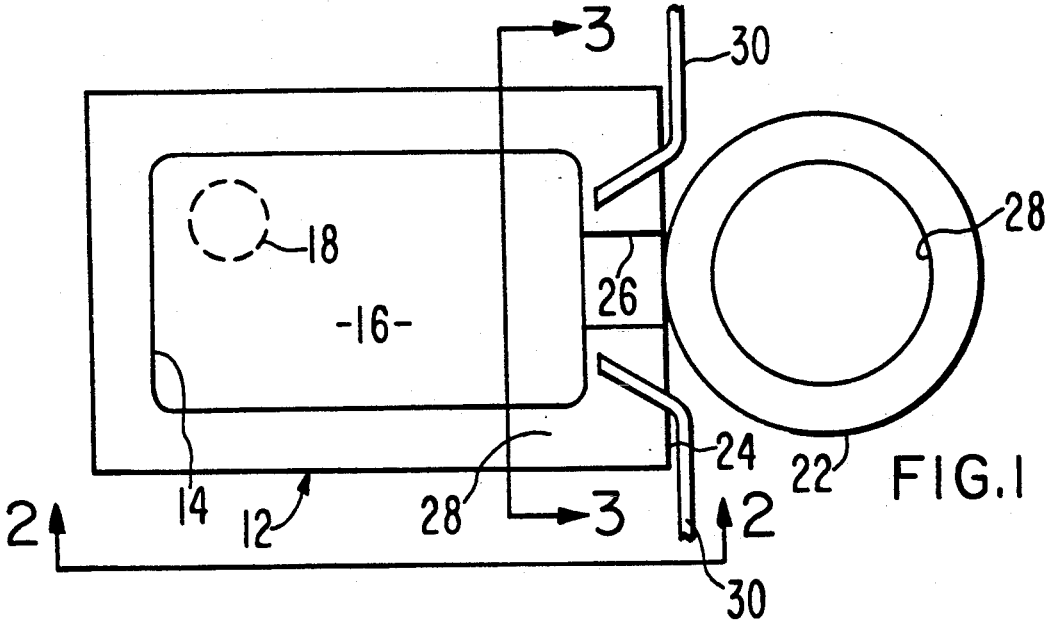
FIG. 1 is a top plan view of a hearth adjacent to a withdrawal crucible or tundish, showing a pair of gas jets of the present invention adjacent to a discharge notch on the upper surface or rim of the hearth.

Metallurgical apparatus 10 of the present invention includes a hearth 12 having an open top 14 and adapted to contain a mass 16 of metal which is to be melted by a suitable heat source, such as a plasma torch 18 (FIGS. 1 and 2) coupled by an electrical circuit 20 to hearth 12. By directing a plasma heated to a high temperature, such as 1200°-1600° C., onto the metal mass 16, the metal in the mass 16 will melt.

The hearth 12 is adapted to be placed adjacent to a withdrawal crucible or tundish 22 which is directly adjacent to one side margin 24 of the hearth 12. A notch 26 in the upper surface 28 of the hearth near margin 24 allows molten metal from the hearth to flow out of the hearth and into the upper open end 28 of crucible 22.

In melting of metal alloys, many impurities appear on the surface of the molten alloy because of density variations. A number of these impurities can be skimmed off the upper surface of the molten metal mass 16.

Figure 2:
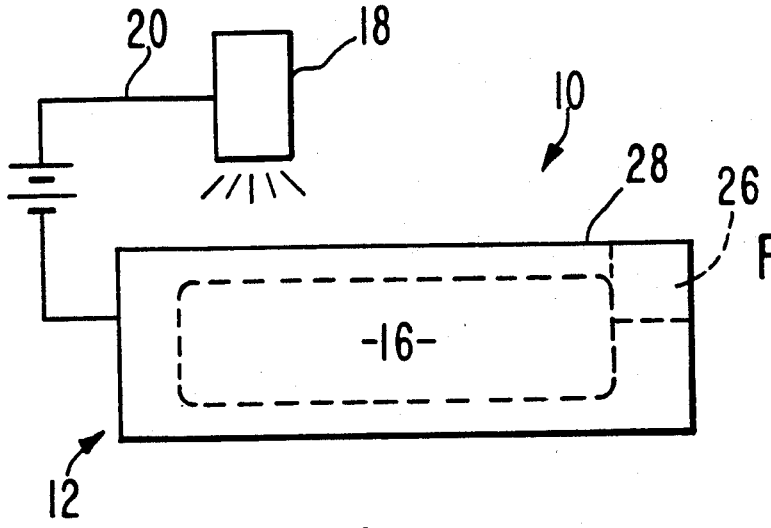
FIG. 2 is an side elevational view of the hearth of FIG. 1, looking in the direction of line 2—2 of FIG. 1.
Figure 3:
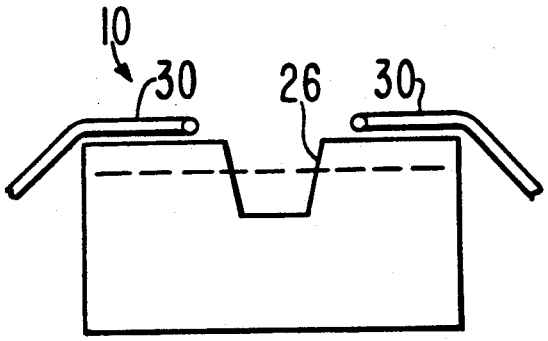
FIG. 3 is a fragmentary end elevational view looking at the inner surface of the hearth near the exit notch at one end of the hearth in the upper surface thereof, showing the positions of the gas jets for blowing a gas across the upper surface of molten metal in the hearth to clear the upper surface of impurities.

To skim such impurities from the upper surface mass 16, one or more gas jets 30 are provided near the upper surface 28 adjacent to margin 24 of hearth 12 as shown in FIGS. 1 and 3. The jets are arranged so that they effectively blow an inert gas, such as argon, helium, and perhaps nitrogen, substantially parallel to the upper surface of the molten mass 16. A non-inert gas, such as CO, could be used and such gas would still provide a skimming effect while providing additional refining capabilities. The pressure of the gas from the jets removes the impurities by blowing them off the top of the molten mass 16 toward the adjacent walls of the hearth. In the alternative, the impurities are herded to specific regions of the hearth where they can be collected. In either case, the impurities are separated from the molten stream of metal leaving the hearth through notch 26 (FIGS. 1-3).

A preferred location of gas jets 30 is in or adjacent to the notch 26 of the hearth 12. The blowing gas does not cause appreciable loss of the molten metal. Furthermore, the gas jets do not adversely affect the performance of the plasma torch 18.

The impurities are removed from the molten alloy to yield a higher quality, i.e., a near defect-free, ingot. Plasma arc hearth melting is ideally suited to the use of a gas barrier provided by the gas from jets 30 because the inert chamber and torch gases can be recirculated, thereby reducing production costs.

In use, a hearth having a solid mass of alloy or superalloy material is subjected to the heat of a torch, such as plasma torch 18 which melts the mass 16 and causes the molten mass to flow from the hearth 12, through notch 26 and into the open top 28 of crucible 22. During the time that the molten metal is flowing out of the hearth through the notch, a gas under a slight pressure is directed into or near one end of the notch to skim or blow the impurities off the top of the molten metal mass 16 and away from the notch, the direction of flow of the gas from the nozzle 30 being shown toward the left hand end of the hearth. At the specific location in the hearth where the impurities are collected, the impurities can be removed by a skimmer device (not shown) off the upper surface of molten mass 16. The result is a high quality ingot in crucible 22 which can be free of any floating type impurities.

We claim:

1. Metallurgical apparatus comprising:

an open top hearth having means for heating a mass of metal in the hearth to a molten condition, said hearth having a wall provided with a fluid outlet therein for allowing molten metal to flow out of the hearth; and means adjacent to the hearth near said wall thereof for directing a gas under pressure in a direction away from the outlet and back into the hearth to remove impruities from the surface of a molten metal in the hearth.

2. Apparatus as set forth in claim 1, wherein said directing means includes at least one gas nozzle adapted to be coupled to a source of gas under pressure.

3. Apparatus as set forth in claim 1, wherein the outlet included a notch for directing molten metal into a crucible, said directing means including a gas jet adjacent to the notch.

4. Apparatus as set forth in claim 3, wherein said gas jet is adjacent to the notch and in a position to direct a flow of gas generally parallel with the upper surface of the molten metal in said hearth.

5. Apparatus as set forth in claim 1, wherein said directing means includes a pair of gas jets, said gas jets being on respective sides of the outlet near the upper surface of the molten metal in the hearth.

6. Apparatus as set forth in claim 1, wherein is included an open top crucible adjacent to the downstream end of the outlet, said directing means including a gas jet between the entrance end of the outlet and the crucible.

7. Apparatus as set forth in claim 1, wherein aid heating means includes a torch above the upper surface of the metal mass in the hearth.

8. Apparatus as set forth in claim 7, wherein said torch is a plasma torch.

9. Apparatus as set forth in claim 1, wherein said gas is inert.

10. Apparatus as set forth in claim 1, wherein the gas is non-inert.

11. A method of purifying a metal having impurities therein comprising:

providing a hearth having an outlet for the flow of molten metal therefrom;

melting a mass of metal in the hearth so that at least some of the impurities of the metal will rise to the upper surface of the molten mass;

directing a fluid under pressure away from said outlet and back into said hearth to blow the impurities off the molten metal; and collecting the impurities.

12. A method as set forth in claim 11, wherein said directing step includes blowing a gas across and substantially parallel with the upper surface of the molten metal to skim the impurities off the top of the molten metal.

13. A method as set forth in claim 11, wherein said directing step is performed as molten metal flows out of the hearth and into a crucible.

14. A method as set forth in claim 11, wherein the directing step includes providing a pair of gas jets in locations on opposite sides of the outlet at which a gas emanating from the jets is blown across the upper surface of the molten metal in the hearth.

15. A method as set forth in claim 11, wherein said melting step includes providing a source of heat above the hearth.

16. A method as set forth in claim 11, wherein said gas is inert.

17. A method as set forth in claim 11, wherein said gas is non-inert.

18. A method as set forth in claim 11, wherein said collecting step is performed as molten metal flows out of the hearth.

19. Metallurgical apparatus comprising:

an open top hearth having means for heating a mass of metal in the hearth to a molten condition, said hearth having a wall provided with a fluid outlet therein for allowing molten metal to flow out of the hearth; and means adjacent to the hearth for directing a gas under pressure generally parallel with the upper surface of the molten metal in the hearth to remove impruities from the upper surface of the molten metal.

20. A method of purifying a metal having impruities therein comprising:

providing a hearth having an outlet for the flow of molten metal therefrom;

melting a mass of metal in the hearth so that at least some of the impurities in the metal will rise to the upper surface of the molten mass;

directing fluid under pressure generally parallel with the surface of the molten metal in the hearth to blow impurities off said upper surface; and collecting the impurities.

* * * * *